US006350562B2

(12) United States Patent
Watanabe et al.

(10) Patent No.: US 6,350,562 B2
(45) **Date of Patent: *Feb. 26, 2002**

(54) CONCENTRATED FIXING SOLUTION AND METHOD FOR PROCESSING SILVER HALIDE PHOTOGRAPHIC MATERIAL USING THE SAME

(75) Inventors: Harumi Watanabe; Minoru Yamada; Mitsunori Hirano; Hisashi Okada, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/620,745

(22) Filed: Mar. 18, 1996

Related U.S. Application Data

(63) Continuation of application No. 08/343,988, filed on Nov. 18, 1994, now abandoned.

(30) Foreign Application Priority Data

Nov. 19, 1993 (JP) ..... 5-312828
Jun. 17, 1994 (JP) ..... 6-135699

(51) Int. Cl.[7] ..... G03C 5/38

(52) U.S. Cl. ..... 430/434; 430/453; 430/455; 430/458

(58) Field of Search ..... 430/453, 455, 430/458, 434

(56) References Cited

U.S. PATENT DOCUMENTS

| | | | | | |
|---|---|---|---|---|---|
| 2,214,216 | A | | 9/1940 | Webster et al. | 95/88 |
| 5,198,327 | A | * | 3/1993 | Yamada et al. | 430/363 |
| 5,272,044 | A | * | 12/1993 | Nishigaki et al. | 430/393 |
| 5,508,158 | A | * | 4/1996 | Yamashita et al. | 430/567 |

* cited by examiner

*Primary Examiner*—Hoa Van Le
(74) *Attorney, Agent, or Firm*—Sughrue Mion, PLLC

(57) ABSTRACT

A concentrated fixing solution which includes at least a thiosulfate, a water-soluble aluminum salt, and a compound having an absorbance of from 0.25 to 1.15 by a prescribed colorimetric method, and does not substantially contain a boron compound is disclosed. A method for processing a silver halide photographic material by using the concentrated fixing solution is also described.

5 Claims, No Drawings

CONCENTRATED FIXING SOLUTION AND METHOD FOR PROCESSING SILVER HALIDE PHOTOGRAPHIC MATERIAL USING THE SAME

This is a Continuation of Application No. 08/343,988 filed Nov. 18, 1994, now abandoned.

FIELD OF THE INVENTION

The present invention relates to a method for processing a silver halide photographic light-sensitive material (hereinafter sometimes referred to as a photographic material or a light-sensitive material) and, particularly, to a fixing solution and a fixing processing method.

BACKGROUND OF THE INVENTION

A silver halide black-and-white photographic material is processed, after being subjected to an exposure, by steps of developing, fixing, washing and drying. In general, a hardening fixing solution containing a water-soluble aluminum salt is used for a hardening processing in the fixing step to shorten the drying time and facilitate a passage of the photographic material in an automatic processor.

However, although the hardening fixing solution containing a water-soluble aluminum salt can prevent generation of a hardly soluble aluminum salt by reducing the pH thereof, a problem of sulfurization arises when it is preserved as a concentrated solution because it contains a thiosulfate as a fixing agent. On the other hand, although the stability of the fixing agent is improved and dyes in the photographic material during processing can be easily dissolved and removed by raising the pH of the hardening fixing solution, the generation of the hardly soluble aluminum salt is accelerated by raising the pH. According, it is preferable that a hardening fixing solution of one ingredient type has a pH of from 4.6 to 4.9. However, the generation of the hardly soluble aluminum salt cannot be completely inhibited if the pH is adjusted to such a range, and particularly the concentrated solution cannot be easily prepared. In general, a boron compound is used to solve these problems in a large amount. The boron compound is carried over to a washing step because the fixing solution is carried over thereto along with the photographic material during processing, and as a result, it is released in environment with a waste water. In the meantime, the environmental preservation has become a world-wide problem in recent years, and it has been strongly demanded in photographic processing to reduce the boron compound contained in a waste water.

To cope with this problem, a method processed by a fixing solution which does not substantially contain a boron compound has been proposed. In this method, a fixing solution is divided into two ingredients, one is an acidic solution containing a water-soluble aluminum salt and the other is a solution containing a thiosulfate and having a pH of from 4.6 to 5.0 or more, and the ingredients are mixed when used. However, it is important and necessary to supply these solutions in one ingredient from the point of conveniences of the supply to users and the usage thereof and further from the production costs.

Regarding this point, it has already been known that an organic acid is effective to prevent the generation of a hardly soluble aluminum compound in the solution used. For example, use of an organic acid such as a gluconic acid, a glycolic acid or a maleic acid instead of a boron compound is disclosed in *Research Disclosure*, No. 18728. In addition to this, examples of replacing a part or the whole of a boron compound with an organic acid are disclosed in *Research Disclosure*, No. 16768 and JP-A-63-284546 (the term "JP-A" as used herein means a "published unexamined Japanese patent application"), but they do not disclose the stability of the solutions which are concentrated. However, when these solutions are supplied to users, it is essential for them to be in the form of concentrated solutions from the point of convenience of the transportation and the storage, and from the viewpoint of reducing the waste package materials, and the storage stability of them is an indispensable characteristic. However, the use of an organic acid in concentrated solution components of one ingredient type hardening fixing solution has not yet been known because a sufficient stability cannot be obtained such that depositions of components arise due to high concentrations of salts of concentrated solution components.

The stabilization of an aluminum salt by an organic acid can be explained by the complex formation thereof but, as described above, components of a concentrated solution of high concentration of salts are liable to be deposited, therefore, it is extremely difficult to apply using methods of organic acids in the known form of solutions used to a concentrated solution. Therefore, whether the stability of one ingredient type concentrated hardening fixing solution can be obtained or not by the use of an organic acid cannot be known at all from the use examples in the form of solutions used.

SUMMARY OF THE INVENTION

An object of the present invention is to provide a concentrated hardening fixing solution of one ingredient type (hereinafter sometimes referred to as "one ingredient type concentrated fixing solution") which does not substantially contain a boron compound that pollutes the environment and which is excellent in aging stability.

Another object of the present invention is to provide a method for processing a photographic material by using the fixing solution.

These and other objects of the present invention have been achieved by a concentrated fixing solution of one ingredient type which comprises at least a thiosulfate, a water-soluble aluminum salt, and a compound having an absorbance of from 0.25 to 1.15, and does not substantially contain a boron compound, wherein the absorbance is measured by an absorptiometer of ultraviolet light/visible light in a solution having a pH of 4.85 and containing a buffer solution of 1.55 mol/liter of an acetic acid/sodium acetate, $2.5\times10^{-4}$ mol/liter of $Al^{3}+$, $2.5\times10^{-5}$ mol/liter of the following compound A, and $5\times10^{-3}$ mol/liter of a compound for evaluation:

(A)

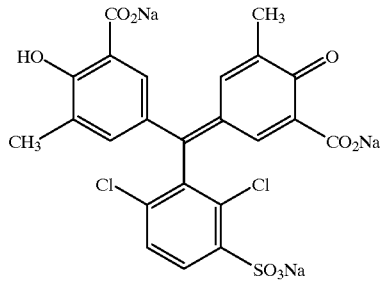

Further, these and other objects of the present invention have been achieved by a method of processing a silver halide photographic material, which comprises the steps of developing an exposed silver halide photographic material, and then processing the developed photographic material with a fixing solution obtained by diluting the above-described concentrated fixing solution to a prescribed concentration.

DETAILED DESCRIPTION OF THE INVENTION

The present invention is described in detail below.

In the present invention, the phrase "which does not substantially contain a boron compound" means that the concentration of the boron compound is 0.04 mol/liter in the fixing solution.

A colorimetric method used in the present invention is a method indirectly representing the stability of a complex formed by an organic acid to be evaluated and $Al^{3+}$ by measuring the absorbance of the complex formed by $Al^{3+}$ which is not masked by the organic acid and compound A. That is, the smaller the absorbance, the larger is the masking ability of $Al^{3+}$.

Practically, a solution having a pH of 4.85 and containing a buffer solution of acetic acid/sodium acetate (1.55 mol/liter in terms of acetic acid), $Al^{3+}$ ($2.5\times10^{-4}$ mol/liter), compound A ($2.5\times10^{-5}$ mol/liter), and a compound to be evaluated ($5\times10^{-3}$ mol/liter) is prepared, and the absorbance of the solution is measured by an absorptiometer of ultraviolet light/visible light at a wavelength of from 500 to 600 nm. The absorbance value of boric acid conventionally used is 1.14 when measured by this method, on the other hand, those of 5-sulfosalicylic acid, iminodiacetic acid, sodium gluconate, malic acid, and tartaric acid are 0.54, 0.90, 0.93, 0.28 and 0.34, respectively.

When a compound having an absorbance value of less than 0.25 by this method is used alone, a sufficient hardening effect cannot be obtained in processing of a photographic material because its masking ability of $Al^{3+}$ is too strong. On the other hand, when a compound having an absorbance value exceeding 1.15 is used alone, since its masking ability of $Al^{3+}$ is too weak, an aluminum compound is deposited during the preparation of a concentrated solution or the storage thereof, or an aluminum hydroxide is deposited in a fixing tank during processing using an automatic processor. On the other hand, a compound having an absorbance value of from 0.25 to 1.15, preferably from 0.4 to 1.12, by this colorimetric method has an appropriate masking ability of $Al^{3+}$ and a sufficient hardening ability, therefore, a sufficient stability can be maintained during the preparation of a concentrated solution, the storage thereof, and the time when the solution is used.

Preferable examples of the compound of the present invention include a gluconic acid and derivatives and salts thereof, an iminodiacetic acid and derivatives and salts thereof, a 5-sulfosalicylic acid and derivatives and salts thereof such as 4-sulfosalicylic acid, a glucoheptanic acid and derivatives and salts thereof. The gluconic acid may be an anhydride having a lactonized ring such as glucono-Δ-lactone. The gluconic acid, the iminodiacetic acid, respective alkali metal salts thereof, and respective ammonium salts thereof are more preferred. These compounds are used in an amount of from 0.01 to 0.45 mol/liter, preferably from 0.015 to 0.3 mol/liter, in one ingredient type concentrated fixing solution which does not substantially not contain a boron compound.

They may be used alone, or two or more kinds of them may be used in combination. Further, they are preferably used in the present invention in combination with one or more compounds, such as organic acids (e.g., malic acid, tartaric acid, citric acid, succinic acid, oxalic acid, maleic acid, glycolic acid, benzoic acid, salicylic acid, Tiron (disodium salt of 1,2-dihydroxybenzene-3,5-disulfonic acid), ascorbic acid, glutaric acid, adipic acid), amino acids (e.g., aspartic acid, glycine, cysteine), aminopolycarboxylic acids (e.g., ethylenediaminetetraacetic acid, diethylenetriaminepentaacetic acid, 1,3-propanediaminetetraacetic acid, nitrilotriacetic acid) and saccharides (e.g., glucose, maltose, cellulose).

The fixing agent of the fixing solution in the present invention are not particularly limited, but ammonium thiosulfate and sodium thiosulfate are preferably used. The amount used of the fixing agent may be varied according to the object and that in the concentrated solution is generally from 0.8 to 6 mol/liter.

The fixing solution of the present invention contains a water-soluble aluminum salt having an effect as a hardening agent, such as aluminum chloride, aluminum sulfate, potassium alum, or aluminum ammonium sulfate. They are preferably contained in an amount of from 0.01 to 0.3 mol/liter, preferably 0.04 to 0.2 mol/liter, in terms of an aluminum ion concentration in the concentrated solution.

The pH of the concentrated fixing solution of the present invention is 4.0 or more and preferably from 4.6 to 5.5.

The fixing solution can include, if necessary, a preservative (e.g., sulfite, bisulfite), a pH buffer (e.g., acetic acid, sodium carbonate, sodium hydrogencarbonate, phosphate, phosphite), a pH adjustor (e.g., sodium hydroxide, ammonia, sulfuric acid), a chelating agent having a water softening ability, compounds disclosed in JP-A-62-78551, a surfactant, a wetting agent, and a fixing accelerator. Specific examples of the surfactant include anionic surfactants such as a sulfide and a sulfone oxide, polyethylene surfactants, and amphoteric surfactants disclosed in JP-A-57-6840, and known defoaming agents can also be used. Specific examples of the wetting agent include alkanolamines and alkylene glycols. Specific examples of the fixing accelerator include alkyl- or aryl-substituted thiosulfonic acids and the salts thereof, thiourea derivatives disclosed in JP-B-45-35754, JP-B-58-122535 and JP-B-58-122536 (the term "JP-B" as used herein means an "examined Japanese patent publication"), alcohols having a triple bond in the molecule, thioether compounds disclosed in U.S. Pat. No. 4,126,459, mercapto compounds disclosed in JP-A-1-4739, JP-A-1-159645 and JP-A-3-101728, mesoionic compounds disclosed in JP-A-4-170539, and ammonium thiocyanate.

The concentrated fixing solution of the present invention is diluted with water to a predetermined concentration when it is used. Particularly, it is diluted in the proportion of from 0.2 to 3 parts by volume of water to one part by volume of the concentrated fixing solution.

The amount added of the concentrated fixing solution is 600 ml/m$^2$ or less, preferably 500 ml/m$^2$ or less, per the processed amount of the photographic material.

Any known development processing method can be used in the present invention, and known development processing solutions can be used. The developing agent of the developing solution which is used in the present invention cannot be particularly limited, but it is preferred to include dihydroxybenzenes and ascorbic acid derivatives, and further, a combination of dihydroxybenzenes or ascorbic acid derivatives with 1-phenyl-3-pyrazolidones, or a combination of dihydroxybenzenes or ascorbic acid derivatives with p-aminophenols is preferred in view of the developing ability.

Specific examples of dihydroxybenzene developing agents for use in the present invention include hydroquinones, chlorohydroquinones, isopropylhydroquinones, and methyl-hydroquinones, and hydroquinones are more preferred. Examples of the ascorbic acid derivative developing agent for use in the present invention include ascorbic acid, isoascorbic acid and the salts thereof.

Specific examples of 1-phenyl-3-pyrazolidones or derivatives thereof which are used in the present invention as a developing agent include 1-phenyl-3-pyrazolidone, 1-phenyl-4,4-dimethyl-3-pyrazolidone, and 1-phenyl-4-methyl-4-hydroxymethyl-3-pyrazolidone. Specific examples of p-aminophenol developing agents include N-methyl-p-aminophenol, p-aminophenol, N-(β-hydroxyethyl)-p-aminophenol, and N-(4-hydroxyphenyl) glycine, and N-methyl-p-aminophenol is more preferred. Dihydroxybenzene developing agents are preferably used in an amount of from 0.05 mol/liter to 0.8 mol/liter. When a combination of dihydroxybenzenes with 1-phenyl-3-pyrazolidones or with p-aminophenols is used, the former is preferably used in an amount of from 0.05 mol/liter to 0.5 mol/liter, and the latter is preferably used in an amount of 0.06 mol/liter or less.

Representative examples of the preservative which are used in the present invention include sodium sulfite, potassium sulfite, lithium sulfite, ammonium sulfite, sodium bisulfite, potassium methabisulfite, and sodium formaldehyde bisulfite. Sulfite is used in an amount of 0.20 mol/liter or more, preferably 0.3 mol/liter or more, but, when the preservative is added in an excessive amount, it is settled in a developing solution and causes a contamination of the solution. The upper limit of the added amount is, therefore, preferably 1.2 mol/liter. Examples of alkali agent for adjusting a pH include a conventional water-soluble inorganic alkali metal salt (e.g., sodium hydroxide, potassium hydroxide, sodium carbonate, potassium carbonate). Additives which can be used in addition to the above include a development inhibitor (e.g., sodium bromide, potassium bromide); an organic solvent (e.g., ethylene glycol, diethylene glycol, triethylene glycol, dimethylformamide); a development accelerator (e.g., alkanolamines such as diethanolamine and triethanolamine, imidazole or derivatives thereof); an antifoggant or a black pepper inhibitor (e.g., mercapto compounds such as 1-phenyl-5-mercaptotetrazole, indazole compounds such as 5-nitroindazole, benzotriazole compound). Further, if necessary, a color adjustor, a surfactant, a defoaming agent, a water softening agent, and a hardening agent may be contained. In addition to the above, compounds disclosed in JP-A-62-212651 as a development streak inhibitor and compounds disclosed in JP-A-61-267759 as a dissolution aid may be used.

The developing solution which is used in the present invention may include, as a buffer, a boric acid disclosed in JP-A-62-186259, saccharides (e.g., saccharose) disclosed in JP-A-60-93433, oximes (e.g., acetoxime), phenols (e.g., 5-sulfosalicylic acid), or tertiary phosphates (e.g., sodium salt, potassium salt).

Processing solutions are desired to be concentrated with a view to reducing transportation costs, waste package materials and spaces, and to be diluted when they are used.

It is effective for concentrating a developing solution that a salt component contained in the developing solution is converted to a potassium salt. The photographic material is subjected to washing or stabilizing processing after being development processed and fixing processed. Washing or stabilizing processing can be carried out with a replenishing amount of 3 liters or less per $m^2$ of the silver halide photographic material (including zero, i.e., washing by water in a reservoir). That is, not only water saving treatment is possible, but also piping for installation of an automatic processor is not necessary. When washing is carried out with a small amount of water, it is preferred to use a washing tank equipped with a squeegee roller or a crossover roller disclosed in JP-A-63-18350 and JP-A-62-287252. The addition of various kinds of oxidizing agents and the provision of filters for filtration may be combined to reduce environmental pollution which becomes a problem when washing is carried out with a small amount of water. Further, all or a part of the overflow generated from the washing tank or the stabilizing tank by the replenishment of water applied with an antimold means, in proportion to the progress of the processing, can be utilized in the preceding processing step, i.e., a processing solution having a fixing ability as disclosed in JP-A-60-235133. Moreover, a water-soluble surfactant or a defoaming agent may be included in washing water to prevent generation of foam streaks which is liable to generate when washing is conducted with a small amount of water and/or to prevent components of the processing agents adhered to a squeegee roller from transferring to the processed film. In addition, dye adsorbents disclosed in JP-A-63-163456 may be included in a washing tank to inhibit contamination by dyes dissolved from the photographic material.

Further, there is a case where the photographic material is subjected to a stabilizing processing after a washing processing. Examples thereof include a bath containing compounds disclosed in JP-A-2-201357, JP-A-2-132435, JP-A-1-102553 and JP-A-46-44446 used as a final bath. This stabilizing bath may contain, if necessary, ammonium compounds, metal compounds such as Bi and Al, brightening agents, various kinds of chelating agents, pH adjusting agents, hardening agents, sterilizers, antimold agents, alkanolamines, and surfactants. Tap water, deionized water, and water sterilized by a halogen or ultraviolet sterilizing lamp, or by various oxidizing agents (e.g., ozone, hydrogen peroxide, chlorate) are preferably used as washing water in a washing step or a stabilizing step. The developing and fixing time of the development processing of the present invention is 40 seconds or less, and preferably from 6 seconds to 35 seconds, and the temperature of each solution is preferably from 25° C. to 50° C., and more preferably from 30° C. to 40° C. The temperature and the time of the washing or stabilizing bath are more preferably from 0 to 50° C. and 40 seconds or less. According to the present invention, the photographic material which has been developed, fixed and washed (or stabilized) is dried after the washing water of which has been squeezed by means of a squeegee roller. Drying is carried out at a temperature of from 40° C. to 100° C., and the drying time is varied optionally depending on circumstances.

Examples of the silver halide of the silver halide emulsion which is used in the photographic material of the present invention include conventional silver halide emulsions comprising, for example, silver bromide, silver iodobromide, silver chloride, silver chlorobromide, and silver chloroiodobromide, and preferably silver chlorobromide containing 60 mol % or more of silver chloride as a negative type silver halide emulsion, or silver chlorobromide, silver bromide, and silver iodobromide containing 60 mol % or more of silver bromide as a positive type silver halide emulsion. The silver halide grains can be prepared by any of an acidic method, a neutral method and an ammoniacal method. The silver halide grains may be those having uniform distribution of silver halide composition within the grains or may be core/shell type grains in which the silver halide compositions are different between the interior and the surface, or may be either grains in which the latent image is mainly formed on the grain surfaces, or grains in which the latent image is mainly formed within the grains. The shape of the silver halide grains for use in the present invention may be any shape, and one preferred example is a cubic having a {100} phase as a crystal surface. Further, grains having an octahedral form, a tetradecahedral form or a dodecahedral form may be prepared and used according to the methods disclosed in, for example, U.S. Pat. Nos. 4,183,756, 4,225,666, JP-A-55-26589, JP-B-55-42737, and *The Journal of Photographic Science*, 21–39 (1973). Grains having twin crystal phases may also be used. The form of the silver halide grains according to the present invention may be uniform, or mixtures of various forms may be used. A monodispersed emulsion is preferably used in the present invention. As monodispersed silver halide grains in the monodispersed emulsion, silver halide grains in which the weight of the silver halide grains included in ±10% of the average grain diameter is 60% or more of the total silver halide grains are preferred.

Various metal ions can be introduced into the interior and/or the surface of the silver halide grains for use in the emulsion of the present invention during formation of the grains or during ripening of the grains by using cadmium salts, zinc salts, lead salts, thallium salts, iridium salts and complex salts thereof, rhodium salts and complex salts thereof, iron salts and complex salts thereof. The photographic emulsions for use in the present invention may be subjected to reduction sensitization using a reducing substance or noble metal sensitization using a noble metal compound in addition to sulfur sensitization or gold-sulfur sensitization. The above emulsion may be used alone or two or more kinds may be mixed as light-sensitive emulsions. After completion of the above described chemical sensitization, various stabilizers can be used in the present invention, for example, 4-hydroxy-6-methyl-1,3,3a,7-tetrazaindene, 5-mercapto-1-phenyltetrazole, and 2-mercaptobenzothiazole. Further, a silver halide solvent such as thioether, and a crystal habit controlling agent such as a mercapto group-containing compound or a sensitizing dye may be used, if necessary. When a so-called hard gradation agent such as a tetrazolium compound, a hydrazine compound or a polyalkylene oxide compound is added to a photographic material, especially a photographic material for printing, in the present invention, preferable effects can be obtained.

The photographic emulsion of the silver halide photographic material of the present invention may be spectrally sensitized using a sensitizing dye to a relatively long wavelength blue light, green light, red light and infrared light. Examples of the dyes used for this sensitization include a cyanine dye, a merocyanine dye, a complex cyanine dye, a complex merocyanine dye, a holopolar cyanine dye, a hemicyanine dye, a styryl dye, and a hemioxonol dye. They may be used alone or in combination. A combination of the sensitizing dyes is often used for the purpose of supersensitization. The hydrophilic colloid layer of the silver halide photographic material of the present invention may contain water-soluble dyes as a filter dye or for the purpose of preventing irradiation, halation, or for various other purposes. Examples of these dyes include an oxonol dye, a hemioxonol dye, a styryl dye, a merocyanine dye, a cyanine dye and an azo dye. Among these, an oxonol dye, a hemioxonol dye and a merocyanine dye are preferred. Specific examples thereof are described in West German Patent No. 616,007, British Patent Nos. 584,609, 1,117,429, JP-B-26-7777, JP-B-39-22069, JP-B-54-38129, JP-A-48-85130, JP-A-49-99620, JP-A-49-114420, JP-A-49-129537, PB Report No. 74175, and *Photographic Abstract*, 128 ('21). These dyes are especially preferred to be used in illuminated room dot-to-dot work photographic materials. A solid fine grain dispersion of a dye disclosed in Japanese Patent No. Application No. 5-244717, pp. 23–30 may also be used. When dyes or UV absorbers are contained in the hydrophilic colloid layer of the silver halide photographic material of the present invention, they may be mordanted with, for example, a cationic polymer.

Various compounds can be added to the above photographic emulsion for preventing lowering of sensitivity and generation of fog during production, storage or processing of the silver halide photographic material. A technique to improve dimensional stability by including a polymer latex in the silver halide emulsion layer or the backing layer can also be used. These techniques are disclosed in, for example, JP-B-39-4272, JP-B-39-17702, and JP-B-43-13482. Gelatin is used as a binder in the photographic material of the present invention, but gelatin derivatives, cellulose derivatives, a graft polymer of gelatin with other polymers, other proteins, sugar derivatives, cellulose derivatives, and hydrophilic colloids of synthetic hydrophilic polymers such as homopolymers or copolymers can be used in combination.

The photographic material of the present invention can further contain various kinds of additives according to purposes. They are described in detail in the *Research Disclosure*, Vol. 176, Item 17643 (December, 1978) and ibid., Vol. 187, Item 18716 (November, 1979), and the locations are shown in the following table.

| Kind of Additive | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizers, Supersensitizers | Pages 23–24 | Page 648, right column to Page 649, right column |
| 4. Brightening Agents | Page 24 | — |
| 5. Antifoggants and Stabilizers | Pages 24–25 | Page 649, right column |
| 6. Light Absorbers, Filter Dyes, UV Absorbers | Pages 25–26 | Page 649, right column to Page 650, left column |
| 7. Antistaining Agents | Page 25, right column | Page 650, left to right columns |
| 8. Color Image Stabilizers | Page 25 | — |
| 9. Hardening Agents | Page 26 | Page 651, left column |
| 10. Binders | Page 26 | " |
| 11. Plasticizers, Lubricants | Page 27 | Page 650, right column |
| 12. Coating Aids, Surfactants | Pages 26–27 | " |
| 13. Antistatic Agents | Page 27 | " |

Examples of the support for use in the photographic material of the present invention includes paper laminated with, for example, α-olefin polymers (e.g., polyethylene, polypropylene, ethylene/butene copolymer), a flexible reflective support (e.g., synthetic paper), a film of semi-synthetic or synthetic polymers (e.g., cellulose acetate, cellulose nitrate, polystyrene, polyvinyl chloride, poly-ethylene terephthalate, polycarbonate, polyamide), a flexible support having provided a reflective layer on the above-described film, and metals, and polyethylene terephthalate is more preferred. Examples of the underlayer which can be used in the present invention include an underlayer treated with organic solvents containing polyhydroxybenzenes disclosed in JP-A-49-3972, and an underlayer treated with water latex disclosed in JP-A-49-11118 and JP-A-52-104913.

The surface of these underlayers may be treated chemically or physically. Such a treatment includes, for example, a surface activation treatment such as a chemical treatment, a mechanical treatment, and a corona discharge treatment. The present invention can be applied to various photographic materials for, for example, printing, X-ray, general negative type, general reversal type, general positive type, direct positive type.

It is preferred that the processing solutions for use in the present invention are preserved in a package material having low oxygen transmission disclosed in JP-A-61-73147. When the replenishing amounts of the processing solutions are reduced, it is preferred to make the contact area of the processing solution with air in the processing tank small to prevent evaporation of the solution or air oxidation. Automatic developing machines of the roller transport type are disclosed in U.S. Pat. Nos. 3,025,779 and 3,545,971, which are merely referred to as roller transport type processors in the present invention. These roller transport type processors comprise four steps of developing, fixing, washing and drying. It is most preferred for the processing of the present invention to follow in these four steps, although other steps (e.g., a stopping step) are not excluded.

The present invention is described in detail with reference to the following examples but it should be understood that the present invention is not to deemed to be limited thereto. All percents, parts and ratios are by weight unless otherwise indicated.

EXAMPLES

Prescription Example 1 (Invention 1)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 75.0 g |
| NaOH | 45.6 g |
| Glacial acetic acid | 92.9 g |
| 5-Sulfosalicylic acid | 60.6 g |
| Aluminum sulfate | 25.3 g |
| pH (adjusted with sulfuric acid or sodium hydroxide) | 4.85 |
| Water to make | 1 liter |

Prescription Example 2 (Invention 2)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 75.0 g |
| NaOH | 37.2 g |
| Glacial acetic acid | 92.9 g |
| Iminodiacetic acid | 31.8 g |
| Aluminum sulfate | 25.3 g |
| pH (adjusted with sulfuric acid or sodium hydroxide) | 4.85 |
| Water to make | 1 liter |

Prescription Example 3 (Invention 3)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 75.0 g |
| NaOH | 37.2 g |
| Glacial acetic acid | 92.9 g |
| Tartaric acid | 8.76 g |
| Sodium gluconate | 5.2 g |
| Aluminum sulfate | 25.3 g |
| pH (adjusted with sulfuric acid or sodium hydroxide) | 4.85 |
| Water to make | 1 liter |

Prescription Example 4 (Invention 4)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 75.0 g |
| NaOH | 25.4 g |
| Glacial acetic acid | 83.6 g |
| Succinic acid | 18.2 g |
| Sodium gluconate | 26.2 g |
| Aluminum sulfate | 25.3 g |
| pH (adjusted with sulfuric acid or sodium hydroxide) | 4.85 |
| Water to make | 1 liter |

Prescription Example 5 (Invention 51)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 75.0 g |
| NaOH | 37.2 g |
| Glacial acetic acid | 92.9 g |
| Sodium gluconate | 5.2 g |
| Malic acid | 8.0 g |
| Aluminum sulfate | 25.3 g |
| pH (adjusted with sulfuric acid or sodium hydroxide) | 5.05 |
| Water to make | 1 liter |

Prescription Example 6 (Invention 6)

| | |
|---|---|
| Ammonium thiosulfate | 350 g |
| Disodium ethylenediaminetetraacetate dihydrate | 0.075 g |
| Sodium sulfite | 37.5 g |
| 1-(N,N-Dimethylamino)-ethyl-5-mercapto-tetrazole | 2.5 g |
| Iminodiacetic acid | 8.5 g |
| NaOH | 37.5 g |
| Glacial acetic acid | 112.5 g |
| Sulfuric acid (36 N) | 9.75 g |
| Aluminum sulfate | 23.6 g |
| pH (adjusted with sulfuric acid or sodium hydroxide) | 4.68 |
| Water to make | 1 liter |

Prescription Example 7 (Comparative Example 1)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 64.8 g |
| NaOH | 25.4 g |
| Glacial acetic acid | 92.9 g |
| Tartaric acid | 8.76 g |
| Boric acid | 23 g |
| Aluminum sulfate | 25.3 g |
| pH (adjusted with sulfuric acid or sodium hydroxide) | 4.85 |
| Water to make | 1 liter |

Prescription Example 8 (Comparative Example 2)

| | |
|---|---|
| Ammonium thiosulfate | 350 g |
| Disodium ethylenediaminetetraacetate dihydrate | 0.075 g |
| Sodium sulfite | 37.5 g |
| Boric acid | 10 g |
| 1-(N,N Dimethylamino)ethyl-5-mercapto-tetrazole | 2.5 g |
| NaOH | 37.5 g |
| Glacial acetic acid | 112.5 g |
| Sulfuric acid (36 N) | 9.75 g |
| Aluminum sulfate | 23.6 g |
| pH (adjusted with sulfuric acid or sodium hydroxide) | 4.68 |
| Water to make | 1 liter |

Prescription Example 9 (Comparative Example 3)

| | |
|---|---|
| Ammonium thiosulfate | 359.1 g |
| Disodium ethylenediaminetetraacetate dihydrate | 0.092 g |
| Sodium thiosulfate pentahydrate | 32.8 g |
| Sodium sulfite | 64.8 g |
| NaOH | 25.4 g |
| Glacial acetic acid | 92.5 g |
| Aluminum sulfate | 25.3 g |
| pH (adjusted with sulfuric acid or sodium hydroxide) | 4.85 |
| Water to make | 1 liter |

Example 1

Solutions of Prescription Examples 1 to 8 were stored under conditions of −5° C. and 50° C., respectively, and the stabilities of the concentrated solutions were evaluated as days of generation of deposit.

The results are shown in Table 1 below.

TABLE 1

| | | Generation of Deposit | |
|---|---|---|---|
| | Boron Compound | −5° C. | 50° C. |
| Prescription 1 (Invention 1) | None | None for 1 month or more | None for 1 month or more |
| Prescription 2 (Invention 2) | None | None for 1 month or more | None for 1 month or more |
| Prescription 3) (Invention 3) | None | None for 1 month or more | None for 1 month or more |
| Prescription 4) (Invention 4) | None | None for 1 month or more | None for 1 month or more |
| Prescription 5 (Invention 5) | None | None for 1 month or more | None for 1 month or more |
| Prescription 6 (Invention 6) | None | None for 1 month or more | None for 1 month or more |
| Prescription 7 (Comparison 1) | Present | Generated on 17th day | None for 1 month or more |
| Prescription 8 (Comparison 2) | Present | None for 1 month or more | None for 1 month or more |
| Prescription 9 (Comparison 3) | None | Generated when it is prepared | Generated when it is prepared |

Example 2

The following unexposed Light-sensitive Material Nos. 1 to 30 described below were processed with Developing Solutions 1 to 3 as described below using an automatic processor FG-460A (a product of Fuji Photo Film Co., Ltd.), fixing processed with the solutions of Prescription Examples 1 to 5 and 7 diluted by 3 times ((fixing temperature)= developing temperature) −1° C.), washed, and then the swollen thickness of the entire film after washing was measured. This made as the index of the hardening ability for comparison. That is, the stronger the hardening ability is, the smaller the swollen film thickness is.

The results are shown in Table 2 below.

TABLE 2

| Light-sensitive | Swollen Film Thickness (μm) | | | | | | | | | | | | | | |
|---|---|---|---|---|---|---|---|---|---|---|---|---|---|---|---|
| Material No. | 1 | 2 | 3 | 4 | 5 | 6 | 7 | 8 | 9 | 10 | 11 | 12 | 13 | 14 | 15 |
| Prescription 1 (Invention 1) | 7.6 | 4.6 | 6.1 | 5.9 | 5.8 | 4.7 | 4.5 | 6.3 | 4.6 | 5.5 | 5.6 | 7.4 | 4.7 | 3.1 | 5.4 |
| Prescription 2 (Invention 2) | 7.6 | 4.5 | 6.0 | 5.8 | 5.7 | 4.5 | 4.5 | 6.2 | 4.5 | 5.5 | 5.6 | 7.3 | 4.7 | 3.1 | 5.2 |
| Prescription 3 (Invention 3) | 7.5 | 4.5 | 5.8 | 5.7 | 5.6 | 4.6 | 4.3 | 6.2 | 4.5 | 5.4 | 5.4 | 7.3 | 4.6 | 3.0 | 5.1 |
| Prescription 4 (Invention 4) | 7.5 | 4.5 | 6.0 | 5.9 | 5.7 | 4.6 | 4.4 | 6.0 | 4.5 | 5.5 | 5.6 | 7.4 | 4.7 | 3.1 | 5.3 |
| Prescription 5 (Invention 5) | 7.4 | 4.5 | 5.9 | 5.8 | 5.5 | 4.5 | 4.5 | 6.0 | 4.6 | 5.4 | 5.4 | 7.3 | 4.6 | 3.0 | 5.4 |

TABLE 2-continued

| | | | | | | | | | | | | | | | |
|---|---|---|---|---|---|---|---|---|---|---|---|---|---|---|---|
| Prescription 7 (Comparison 1) | 7.5 | 4.5 | 6.1 | 5.8 | 5.7 | 4.6 | 4.4 | 6.0 | 4.5 | 5.4 | 5.5 | 7.4 | 4.6 | 3.0 | 5.3 |

| Light-sensitive | Swollen Film Thickness (μm) | | | | | | | | | | | | | | |
|---|---|---|---|---|---|---|---|---|---|---|---|---|---|---|---|
| Material No. | 16 | 17 | 18 | 19 | 20 | 21 | 22 | 23 | 24 | 25 | 26 | 27 | 28 | 29 | 30 |
| Prescription 1 (Invention 1) | 5.1 | 4.3 | 7.0 | 5.5 | 5.4 | 3.1 | 5.4 | 5.4 | 4.6 | 5.3 | 7.6 | 4.0 | 4.4 | 4.5 | 3.8 |
| Prescription 2 (Invention 2) | 5.0 | 4.2 | 7.1 | 5.4 | 5.4 | 3.1 | 5.3 | 5.3 | 4.5 | 5.2 | 7.7 | 4.0 | 4.4 | 4.5 | 3.8 |
| Prescription 3 (Invention 3) | 5.0 | 4.1 | 6.9 | 5.5 | 5.3 | 3.0 | 5.1 | 5.3 | 4.5 | 5.0 | 7.3 | 3.8 | 4.3 | 4.4 | 3.5 |
| Prescription 4 (Invention 4) | 5.1 | 4.2 | 7.0 | 5.6 | 5.3 | 3.0 | 5.1 | 5.2 | 4.5 | 5.0 | 7.4 | 3.9 | 4.3 | 4.4 | 3.5 |
| Prescription 5 (Invention 5) | 5.1 | 4.1 | 7.0 | 5.6 | 5.4 | 3.1 | 5.2 | 5.3 | 4.6 | 5.1 | 7.5 | 3.8 | 4.4 | 4.3 | 3.7 |
| Prescription 7 (Comparison 1) | 5.0 | 4.2 | 7.0 | 5.5 | 5.3 | 3.0 | 5.3 | 5.2 | 4.5 | 5.0 | 7.5 | 3.9 | 4.3 | 4.3 | 3.6 |

| Light-sensitive Material | Developing Solution | Processing Temperature (C) | Processing Time (second) |
|---|---|---|---|
| 1. Photographic light-sensitive material disclosed in JP-A-62-235939 (corresponding to U.S. Pat. No. 4,818,659) | 1 | 34 | 30 |
| 2. Photographic light-sensitive material disclosed in JP-A-5-11389 | 2 | 38 | 20 |
| 3. described below | 1 | 34 | 30 |
| 4. Photographic light-sensitive material disclosed in JP-A-62-234156 | 3 | 38 | 20 |
| 5. Light-sensitive material prepared by using Emulsion 1-1 in Example 1 of JP-A-5-165137 | 3 | 38 | 20 |
| 6. Light-sensitive material No. 1 in Example 1 of JP-A-5-265147 | 1 | 34 | 30 |
| 7. Scanner Film LS-4500 | 2 | 38 | 20 |
| 8. Camera Film S-FA100 | 1 | 34 | 30 |
| 9. Ortho Film RO 100-II | 3 | 38 | 20 |
| 10. Contact Film VU-S100 | 1 | 34 | 30 |
| 11. Contact Film KU-V100 | 2 | 38 | 20 |
| 12. Facsimile Film XE-100M | 3 | 38 | 20 |
| 13. Computerized Photo Type Setting Paper PH-100WP | 3 | 38 | 20 |
| 14. Laser Paper PD-100WP | 2 | 38 | 20 |
| 15. Contact Film FKH | 2 | 38 | 20 |
| 16. Camera Film FCP | 2 | 38 | 20 |
| 17. Camera Film FCS | 2 | 38 | 20 |
| 18. Contact Film VU-W | 1 | 38 | 20 |
| 19. Contact Film LU-W | 1 | 38 | 20 |
| 20. Scanner 2000 Film SAI | 2 | 38 | 20 |
| 21. Camera 2000 Film CGP | 2 | 38 | 20 |
| 22. Ultratech Film UFZ | 1 | 34 | 30 |
| 23. Imageset 2000 Film IHN | 2 | 38 | 20 |
| 24. Scanner Film RSP-3 | 2 | 38 | 20 |
| 25. Contact Film CRH-A | 1 | 38 | 20 |
| 26. Scanner Film RHG-3 | 1 | 34 | 30 |
| 27. Illuminated Room Dot-to-Dot Work Film DCL-PF100 | 2 | 38 | 20 |
| 28. Camera Film TL | 2 | 38 | 20 |
| 29. Contact Film Contact C | 1 | 38 | 20 |
| 30. Contact Film Contact CG | 1 | 38 | 20 |

In the above light-sensitive materials, Nos. 7 to 19 are produced by Fuji Photo Film Co., Ltd., Nos. 20 to 23 are produced by Eastman Kodak Company, Nos. 24 to 26 are produced by KONICA CORPORATION, No. 27 is produced by Mistubishi Paper Mills Ltd., and Nos. 28 to 30 are produced by AGFA-Gevaert, N.V.

Light-sensitive Material No.3 described above

An aqueous silver nitrate solution and an aqueous potassium bromide solution were simultaneously added to 800 ml of an aqueous gelatin solution (concentration of gelatin: 3.5% by weight) maintained at 50° C. and at over a period of 30 minutes while maintaining the pAg at 7.8 in the presence of ammonia, and then the same amount of an aqueous silver nitrate solution and an aqueous potassium bromide and potassium iodide solution containing $K_3IrCl_6$ of $4\times10^{-7}$ mol per mol of silver were simultaneously added thereto over a period of 30 minutes while maintaining the pAg at 7.8 to obtain a cubic monodisperse silver iodobromide emulsion having an average grain diameter of 0.28 μm and a silver iodide content of 0.4% (variation coefficient: 10%).

The temperature of this emulsion was lowered to 40° C. and desalted using the flocculation method, and further, gelatin, an aqueous KBr solution (pAg was adjusted to 9.0), and phenoxyethanol as a preservative were added thereto. The temperature was then raised to 50° C., and Sensitizing Dye (1) described below was further added to the emulsion in an amount of $5\times10^{-4}$ mol per mol of silver and, after allowing to stand for 5 minutes, a KI solution was added in an amount of $10^{-3}$ mol per mol of silver. After 10 minutes, the conversion was carried out, and the temperature was lowered.

Sensitizing Dye (1)

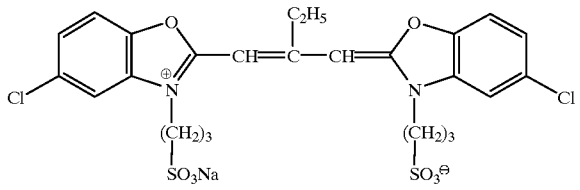

4-Hydroxy-6-methyl-1,3,3a,7-tetrazaindene as a stabilizing agent, 5-methylbenzotriazole, the nucleation accelerator described below, and a monomethine cyanine dye were added to the above obtained emulsion so that each of them was coated in an amount of 5 mg/m². $2\times10^{-3}$ mol of the following Hydrazine Compound (1) and $7\times10^{-4}$ mol of the following Hydrazine Compound (2) each per mol of silver as hydrazine compounds, 75 mg/m$^2$ of polyethylene glycol having an average molecular weight of 600, polyethylene acrylate dispersion in an amount of 30 wt % as a solid based on gelatin, and 1,3-divinylsulfonyl-2-propanol as a hardening agent were added thereto, and the emulsion thus obtained was coated in an amount of 3.5 g/m$^2$ in terms of silver (gelatin: 2 g/m$^2$) on gelatin layer of 0.4 g/m$^2$ provided on a polyethylene terephthalate film. A layer containing 1.0 g/m$^2$ of gelatin, 40 mg/m$^2$ of an amorphous $SiO_2$ matting agent having an average grain diameter of about 3 $\mu$m, 0.1 g/m$^2$ of colloidal silica (Snowtex C manufactured by Nissan Chemical Industries, Ltd.), 100 mg/m$^2$ of polyacrylamide, 200 mg/m$^2$ of hydroquinone, silicone oil, proxel and phenoxyethanol as preservatives, and a fluorine surfactant described below and sodium dodecylbenzenesulfonate as a coating aid was simultaneously coated on the above emulsion layer as a protective layer, and thus the sample was prepared.

Nucleation Accelerator

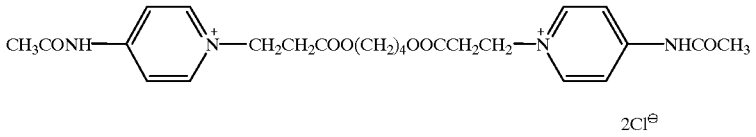

Monomethine Cyanine Dye

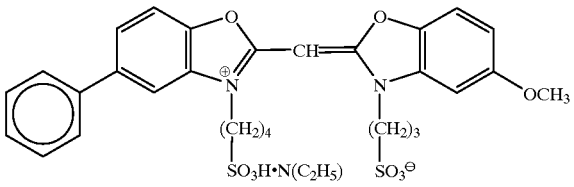

Hydrazine Compound (1)

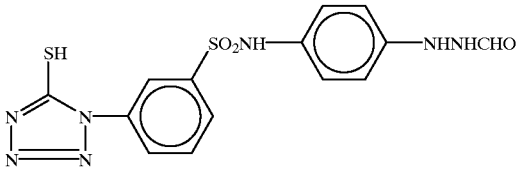

Hydrazine Compound (2)

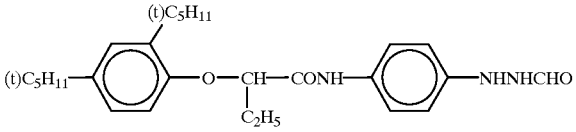

Fluorine Surfactant

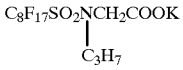

A backing layer was prepared according to the following composition.

Composition of Backing Layer

| | |
|---|---|
| Gelatin | 4 g/m$^2$ |
| Matting Agent: Polymethyl methacrylate (grain diameter: 3.0 to 4.0 $\mu$m) | 10 mg/m$^2$ |
| Polyethyl acrylate latex | 2 g/m$^2$ |
| Surfactant: Sodium p-dodecylbenzene-sulfonate | 40 mg/m$^2$ |
| Fluorine surfactant described above | 5 mg/m$^2$ |
| Gelatin hardening agent described below | 110 mg/m$^2$ |
| Mixture of the following dyes | |
| Dye (a) | 50 mg/m$^2$ |
| Dye (b) | 100 mg/m$^2$ |
| Dye (c) | 50 mg/m$^2$ |

Gelatin Hardening Agent

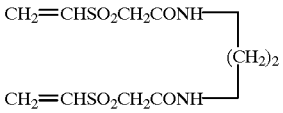

Dye (a )

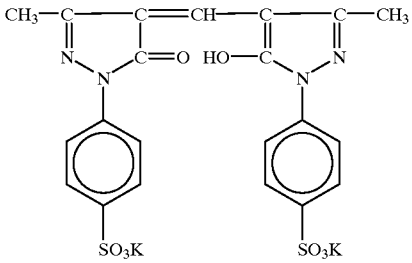

Dye (b)

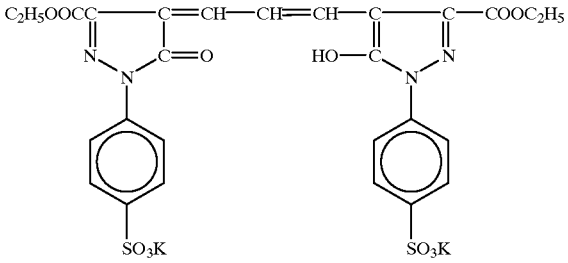

Dye (c)

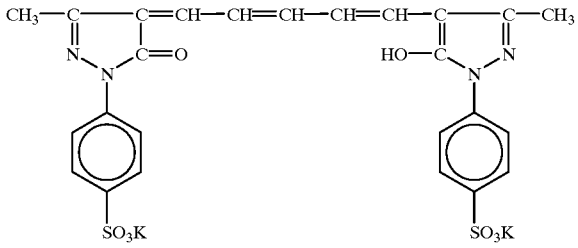

Proxel and phenoxyethanol were added to the backing layer coating solution as preservatives.

Preparation of Developing Solution

Developing Solution 1

| | |
|---|---|
| Sodium hydroxide | 8.0 g |
| Potassium hydroxide | 90.0 g |
| 5-Sulfosalicyclate | 23 g |
| N-n-Butyldiethanolamine | 14 g |
| N,N-Dimethylamino-2-hexanol | 0.2 g |
| Sodium p-toluenesulfonate | 8 g |
| Boric acid | 24 g |
| Disodium ethylenediaminetetraacetate | 1 g |
| Potassium bromide | 10 g |
| 5-Methylbenzotriazole | 0.4 g |
| Sodium 2-mercaptobenzimidazole-5-sulfonate | 0.3 g |
| Sodium 3-(5-Mercaptotetrazole)benzene-sulfonate | 0.2 g |
| Sodium metabisulfite | 65 g |
| Hydroquinone | 55 g |
| N-Methyl-p-aminophenol | 0.5 g |
| Water to make | 1 liter |
| pH | 11.92 |

Developing Solution 2

| | |
|---|---|
| Diethylenetriaminepentaacetic acid | 2 g |
| Potassium hydroxide | 35 g |
| Sodium metabisulfite | 40 g |
| Potassium carbonate | 12 g |
| Potassium bromide | 3 g |
| 5-Methylbenzotriazole | 0.08 g |
| Sodium 2-mercaptobenzimidazole-5-sulfonate | 0.15 g |
| 2,3,5,6,7,8-Hexahydro-2-thioxo-4-(1H)-quinazolinone | 0.04 g |
| Sodium erythrobinate | 3.0 g |
| 4-Methyl-4-hydroxymethyl-1-phenyl-3-pyrazolidone | 0.45 g |
| Hydroquinone | 25 g |
| Water to make | 1 liter |
| pH | 10.5 |

Developing Solution 3

| | |
|---|---|
| Soft water | 240 ml |
| Disodium ethylenediaminetetraacetate | 2.8 g |
| Potassium hydroxide | 34 g |
| Potassium bisulfite | 47 g |
| Sodium carbonate | 11 g |
| Potassium bromide | 3 g |
| 5-Methylbenzotriazole | 0.1 g |
| Sodium 2-mercaptobenzimidazole-5-sulfonate | 0.3 g |
| 4-Methyl-4-hydroxymethyl-1-phenyl-3-pyrazolidone | 0.5 g |

-continued

| | |
|---|---|
| Hydroquinone | 24 g |
| Water to make | 1 liter |
| pH | 10.8 |

Example 3

Preparation of Emulsion 5 g of potassium bromide, 25.6 g of gelatin, and 2.5 ml of a 5% aqueous solution of thioether ($OH(CH_2)_2S(CH_2)_2S(CH_2)_2OH$) were added to 1 liter of water, and the temperature of the solution was maintained at 66° C. An aqueous solution containing 8.33 g of silver nitrate and an aqueous solution containing 5.94 g of potassium bromide and 0.726 g of potassium iodide were added thereto while stirring by the double jet method over a period of 45 seconds.

After of 2.9 g of potassium bromide was added, an aqueous solution containing 8.33 g of silver nitrate was added thereto over a period of 24 minutes, and then 0.1 mg of the following thiourea dioxide was further added thereto.

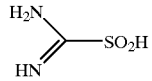

Then, 20 ml of a 25% aqueous ammonia solution and 10 ml of a 50% aqueous solution of ammonium nitrate were added to the solution and physically ripened for 20 minutes, and further 240 ml of 1 N sulfuric acid was added thereto for neutralization.

Subsequently, an aqueous solution containing 153.34 g of silver nitrate and an aqueous solution containing potassium bromide and potassium iodide were added thereto by the controlled double jet method over a period of 40 minutes while maintaining the pAg of 8.2. The flow rate at this time was accelerated so that the final flow rate was 9 times as much as the flow rate at the start of the addition.

After the termination of addition, 15 ml of a 2 N potassium thiocyanate solution was added, and further, 45 ml of a 1% aqueous solution of potassium iodide was added over a period of 30 seconds.

After the temperature was then lowered to 35° C. and the soluble salts were removed by the precipitation method, the temperature was raised to 40° C. and 76 g of gelatin, 76 mg of proxel and 760 mg of phenoxyethanol were added thereto, and the pH and the pAg of the emulsion were adjusted to 6.5 and 8.20, respectively, by adding sodium hydroxide and potassium bromide.

The temperature was raised to 56° C. and subsequently 186 mg of 4-hydroxy-6-methyl-1,3,3a,7-tetrazaindene was added and allowed to stand for 10 minutes, and then 520 mg of Sensitizing Dye (2) described below was added.

Sensitizing Dye (2)

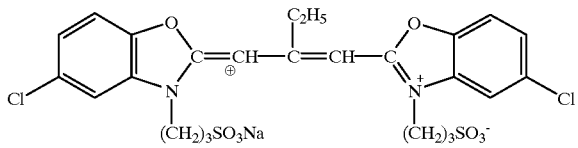

99.5% of the sum total of the projected area of the grains of the thus obtained emulsion were grains having an aspect ratio of 3 or more, and all the grains having an aspect ratio of 2 or more had an average projected area diameter of 1.48 μm, a standard deviation of 25.6%, an average grain thickness of 0.195 μm, an aspect ratio of 7.6, and the total iodide amount was 1.2 mol % per the total silver amount.

Preparation of Coating Solution for Emulsion

The following compounds were added to the above obtained emulsion in the amount described below per mol of the silver halide to prepare a coating solution.

| | |
|---|---|
| Polymer latex (poly(ethyl acrylate/methacrylic acid): copolymerization ratio: 97/3) | 25.0 g |
| Hardening agent (1,2-bis(vinylsulfonyl-acetamido)ethane) | 3.0 g |
| 2,6-Bis (hydroxyamino)-4-diethylamino 1,3,5-triazine | 80 mg |
| Sodium polyacrylate (average molecular weight: 41,000) | 4.0 g |
| Potassium polystyrenesulfonate (average molecular weight: 600,000) | 1.0 g |
| Polyacrylamide (average molecular weight: 45,000) | 24 g |

Preparation of Support

The following compounds were coated in the coating amount described below on both surfaces of a blue-colored polyethylene terephthalate support having a thickness of 175 μm to prepare a support having subbing layers.

| | |
|---|---|
| Gelatin | 84 mg/m$^2$ |
| Polymer described below | 60 mg/m$^2$ |
| Dye described below | 17 mg/m$^2$ |

Polymer

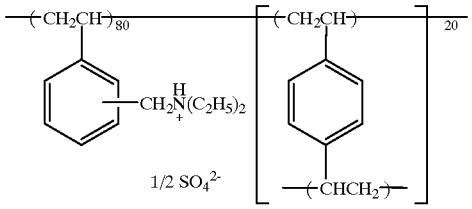

Dye

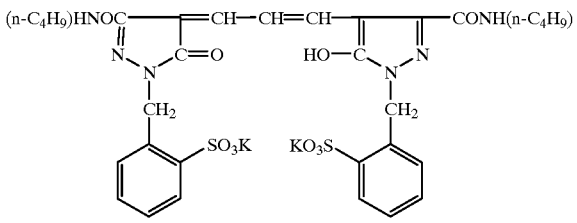

Preparation of Photographic Material

The above coating solution was coated on both surfaces of the above support simultaneously with the following coating solution for the surface protective layer. The coating amount of silver was 1.85 g/m$^2$ per one surface. The coating amount of each component of the coating solution for the surface protective layer is described below.

Composition of Surface Protective Layer

| | |
|---|---|
| Gelatin | 1.15 g/m$^2$ |
| Polyacrylamide (average molecular weight: 45,000) | 0.25 g/m$^2$ |
| Sodium polyacrylate (average molecular weight: 400,000) | 0.02 g/m$^2$ |
| Sodium salt of p-t-octylphenoxydi-glycerylbutylsulfonate | 0.02 g/m$^2$ |
| Poly(polymerization degree 10)-oxyethylenecetyl Ether | 0.035 g/m$^2$ |
| Poly(polymerization degree 10)oxyethylene-poly(polymerization degree 3)oxyglyceryl-p-octylphenoxy ether | 0.01 g/m$^2$ |
| 4-Hydroxy-6-methyl-1,3,3a,7-tetrazaindene | 0.0155 g/m$^2$ |
| 2-Chlorohydroquinone | 0.154 g/m$^2$ |
| $C_8F_{17}SO_3K$ | 0.003 g/m$^2$ |
| Compound X described below | 0.001 g/m$^2$ |
| Compound Y described below | 0.003 g/m$^2$ |
| Polymethyl methacrylate (average grain diameter: 3.5 μm) | 0.025 g/m$^2$ |
| Poly(methyl methacrylate/methacrylate) (copolymerization ratio: 7/3, average grain size: 2.5 μm) | 0.020 g/m$^2$ |

Thus, the light-sensitive material having a swelling rate of the coated film of 230% was obtained.

Compound X

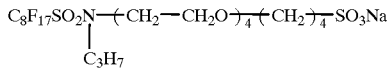

Compound Y

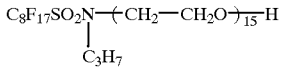

Development Processing

Preparation of Concentrated Developing Solution

Component A

| | |
|---|---|
| Potassium hydroxide | 330 g |
| Potassium sulfite | 630 g |
| Sodium sulfite | 255 g |
| Potassium carbonate | 90 g |
| Boric acid | 45 g |
| Diethylene glycol | 180 g |
| Diethylenetriaminepentaacetic acid | 30 g |
| 1-(N,N-Diethylamino)ethyl-5-mercapto-tetrazole | 0.75 g |
| Hydroquinone | 450 g |
| Water to make | 4,125 ml |

Component B

| | |
|---|---|
| Diethylene glycol | 525 g |
| 3,3'-Dithiobishydrocinnamic acid | 3 g |
| Glacial acetic acid | 102.6 g |
| 5-Nitroindazole | 3.75 g |
| 1-Phenyl-3-pyrazolidone | 34.5 g |
| Water to make | 750 ml |

Component C

| | |
|---|---|
| Glutaraldehyde (50 wt/wt %) | 150 g |
| Potassium bromide | 15 g |
| Potassium metabisulfite | 105 g |
| Water to make | 750 ml |

Preparation of Processing Solution

Each part of the above concentrated developing solution was filled in each container. Each container of Part A, B and C is connected in one body by the container itself.

Also, the concentrated fixing solutions of Prescription Examples 6 and 8 were respectively filled in the same kind of containers.

At first, 20 ml of an aqueous solution containing 3.7 g of potassium bromide and 3.6 g of acetic acid per liter of the developing solution was added in a developing tank as a starter. The containers filled with the processing solutions were put upside down on the processing solution stock tank equipped on the side of an automatic processor and the drilling blades of the stock tank were driven into the caps of the containers and the processing solutions were filled in the stock tank.

These developing solution and fixing solution were filled in the developing tank and the fixing tank of the automatic processor, respectively, in the ratios described below, using the fixed quantity pumps equipped to the automatic processor.

Also, each concentrated processing solution and water were mixed in the same ratios and replenished to the tank of the automatic processor each time when 8 sheets of the photographic material calculated as a full size (10×12 inches) were processed.

Developing Solution

| | |
|---|---|
| Component A | 55 ml |
| Component B | 10 ml |
| Component C | 10 ml |
| Water | 125 ml |
| pH | 10.50 |

Fixing Solution

| | |
|---|---|
| Concentrated fixing solution | 80 ml |
| Water | 120 ml |
| pH | 4.62 |

Tap water was filled in a washing tank.

The replenishing amount of the washing water was 3 liter/min. only during processing of the photographic material.

An aqueous solution containing 60 g of ethylenediaminetetraacetic acid dihydrate and 20 g of glutaraldehyde per liter was replenished constantly whether the processor was operating or not in a ratio of about 10 ml per hour (the addition was carried out every 15 minutes for 1 minute, that is, 4 times per hour, using a pulse pump) to prevent generation of water scum.

Constitution of Automatic Processor

An automatic processor having the composition as described in Table 3 was used. Drying zone was carried out according to the drying technique disclosed in JP-A-5-265146.

TABLE 3

| | Volume of Tank (l) | Processing Temperature (° C.) | Processing Pass Length (mm) | Processing Step Time (sec) |
|---|---|---|---|---|
| Development | 15 | 35 | 621 | 13.3 |
| | (liquid surface area/volume of tank = 35 $cm^2$/liter) | | | |
| Fixing | 15 | 32 | 546 | 11.7 |
| Washing | 13 | 17 | 266 | 5.7 |
| | | (running water) | | |
| Squeegee | | | 308 | 6.6 |
| Drying | | 58 | 373 | 8.0 |
| Total | | | 2,114 | 45.3 |

Processing

The above described photographic material was X-ray exposed, and processed using the above automatic processor and each processing solution prepared by mixing in the above described ratios and by the above described processing steps with replenishing 25 ml of the developing solution and 25 ml of the fixing solution per one sheet as a full size (10×12 inches).

About 150 sheets calculated as the full size were processed every day for one month. The differences in drying ability and drying streaks were not observed between the fixing solution of Prescription 6 (Invention 6) containing the compound of the present invention and that of Prescription 8 (Comparison 2) containing a boric acid.

As is apparent from the results shown in Tables 1 and 2 and the results in Example 3, the concentrated fixing solutions of Prescriptions 1 to 6 of the present invention which do not substantially contain a boron compound that may pollute the environment have an excellent aging stability during storage as a concentrated solution and maintain the equal hardening ability to that of the conventional hardening fixing solution.

Accordingly, by using a compound having an absorbance of from 0.25 to 1.15 when measured by the colorimetric method using the above-described Compound A, in one ingredient type concentrated hardening fixing solution which does not substantially contain a boron compound that may pollute the environment, the equal hardening ability to that of the conventional hardening fixing solution can be maintained and an excellent aging stability of the concentrated solution can be obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material, which comprises the step of:

developing an exposed silver halide photographic material, wherein the development time is 20 to 30 seconds; and then processing the developed photographic material with a fixing solution obtained by diluting a concentrated fixing solution to a prescribed concentration, wherein the concentrated fixing solution comprises at least a thiosulfate, a water-soluble aluminum salt, and a compound having an absorbance of from 0.25 to 1.15, and does not substantially contain a boron compound, wherein the absorbance is measured by an absorption meter of ultraviolet light/visible light in a solution having a pH of 4.85 and containing a buffer solution of 1.55 mol/liter of an acetic acid/sodium acetate, $2.5\times10^{-4}$ mol/liter of $Al^{3+}$, $2.5\times10^{-5}$ mol/liter of the following compound A, and $5\times10^{-3}$ mol/liter of a compound for evaluation:

(A)

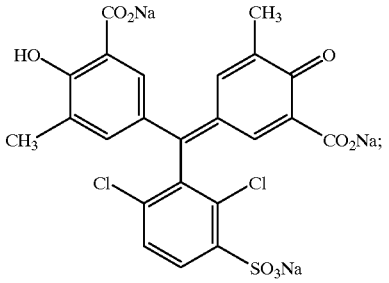

and wherein the compound having an absorbance of from 0.25 to 1.15 is selected from the group consisting of an iminodiacetic acid, and salts thereof; a gluconic acid, and salts thereof; a 5-sulfosalicylic acid, and salts thereof, and a glucoheptanic acid, and salts thereof.

2. The method of processing a silver halide photographic material as claimed in claim 1, wherein one part by volume of the concentrated fixing solution is diluted with from 0.2 to 3 parts by volume of water.

3. The method of processing a silver halide photographic material as claimed in claim 1, wherein the compound having an absorbance of from 0.25 to 1.15 is a gluconic acid or a salt thereof.

4. The method of processing a silver halide photographic material as claimed in claim 3, wherein the compound having an absorbance of from 0.25 to 1.15 is a gluconic acid anhydride having a lactonized ring.

5. The method of processing a silver halide photographic material as claimed in claim 4, wherein the compound having na absorbance of from 0.25 to 1.15 is glucono-Δ-lactone.

* * * * *